United States Patent [19]

Harris

[11] Patent Number: 4,485,428

[45] Date of Patent: Nov. 27, 1984

[54] HIGH VOLTAGE PULSE GENERATOR

[75] Inventor: Neville W. Harris, Acton, Mass.

[73] Assignee: High Voltage Engineering Corp., Burlington, Mass.

[21] Appl. No.: 376,667

[22] Filed: May 10, 1982

[51] Int. Cl.[3] ..... H05F 3/00

[52] U.S. Cl. ..... 361/235; 323/903; 250/324; 55/139

[58] Field of Search ..... 361/235; 323/903; 307/2; 55/139; 250/324

[56] References Cited

U.S. PATENT DOCUMENTS

| | | | |
|---|---|---|---|
| 1,959,374 | 5/1934 | Lissman | 307/107 |
| 4,232,355 | 11/1980 | Finger et al. | 361/235 |
| 4,233,039 | 11/1980 | Schmidt | 55/139 |

*Primary Examiner*—Reinhard J. Eisenzopf

*Attorney, Agent, or Firm*—Henry C. Nields

[57] ABSTRACT

A high voltage pulse generator is provided which so interacts with the parameters of an electrostatic precipitator that excellent pulse waveforms are obtained more efficiently by using less elaborate components than heretofore required. A major feature of the invention is the charging of the pulse forming network through the high-voltage d.c. source which energizes the precipitator for charge-particulate removal.

11 Claims, 6 Drawing Figures

HIGH VOLTAGE PULSE GENERATOR

FIELD OF INVENTION

This invention generally pertains to high voltage pulse generators and more particularly relates to generators applying high voltage pulses to the electrodes of electrostatic precipitators.

BACKGROUND

In the operation of electrostatic precipitators it has been found that the precipitation efficiency is improved if high voltage pulses of short duration are superimposed on an underlying, relatively constant, base voltage. The reason for this improvement comes from the separation of functions of the electric field. The first function, provision of charge carriers for the charging of the particulates entrained in the gas, is performed by a corona discharge from at least one of the electrodes in the precipitator. This requires a very high electric field at the corona-emitting electrode. The field must be high, but it is not necessary that it be continuous. The second function, charging and transport of the particulates, requires a high average electric field which is most effective if continuously applied.

It is highly desirable to be able to vary these functions separately so as to maximize particulate entrapment for any given conditions of temperature, gas and particulate composition.

Pulse energization as a means of enhancing particle collection has long been recognized and several authors have published results of tests, c.f. Kumar, K. S., Feldman, P. L., Milde, H. I. and Schubert, C. J. "The results of first full scale utility demonstration of pulsed precipitation." 1979 Conference Record of IEEE-IAS-1979 Annual Meeting. The advantages of pulse energization are very significant because the corona is no longer solely dependant on the applied base voltage. It can, in addition, be controlled by pulse amplitude, pulse width and pulse frequency. This added dimension is especially important for highly resistive dust. To eliminate back corona, it is necessary to limit current density. Traditionally this is accomplished by reducing voltage. For these smaller allowable current densities, the corresponding voltage is very close to the corona onset point, producing poorly distributed corona along the discharge wires. There will thus be regions filled with excessive corona current and regions with little or none. It has been found that the application of infrequent pulses at levels well above the corona onset voltage eliminates the problem of nonuniform corona.

The application of pulsed energization technology to the collection of difficult dusts has been the subject of several engineering studies. However, its acceptance in industry has not been successful until recently because of a combination of problems related to reliability, economics and versatility of the available hardware.

The present invention seeks to improve the efficiency and lower the cost of the pulse generator by arrangement of the circuitry connecting the pulse generator to the precipitator and base voltage supply.

SUMMARY OF THE INVENTION

The principal object of the invention, in general, is to improve the efficiency and reduce complexity of the pulse generator that supplies high voltage pulses of short duration of the precipitator. This is accomplished by using the d.c. voltage source which energizes the precipitator as part of the voltage source which charges the pulse-forming network (PFN), so that the PFN is charged through the d.c. voltage source itself. This can be done by supplying the charging current directly through the dc supply or in a delayed mode, whereby instantaneous current is supplied by the decoupling capacitor and the decoupling capacitor is slowly recharged from the dc supply.

DETAILED DESCRIPTION OF A PREFERRED EMBODIMENT

The invention may best be understood from the following detailed description thereof, having reference to the accompanying drawings, in which.

Figure 1:
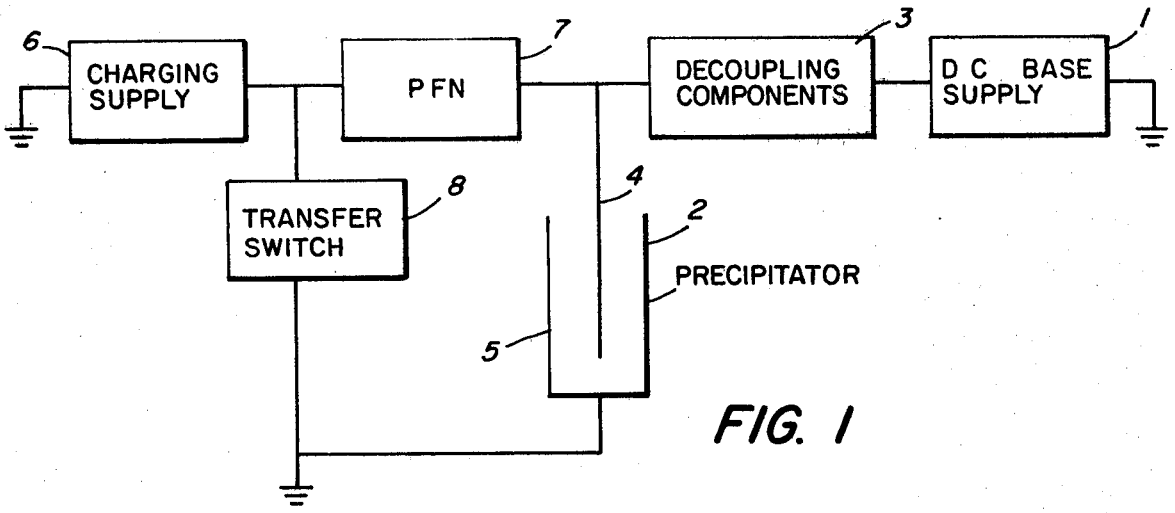
FIG. 1 is a block diagram showing the major components of an electrostatic precipitator having a high voltage pulse generator embodying the principles of the invention.
Figure 6:
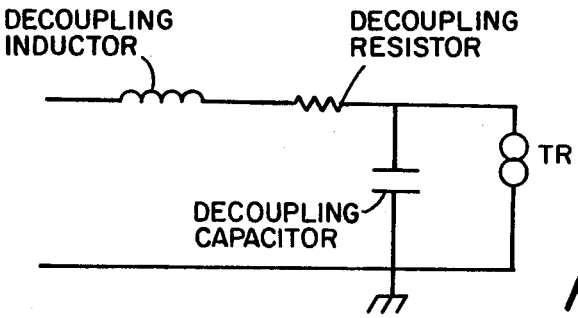
FIG. 6 is a detail of the decoupling components portion of FIG. 1.

Referring to the drawings, and first to FIG. 1 thereof, therein is shown a diagrammatic view illustrating one form of apparatus for carrying out the invention. In this circuit, a d.c. base supply 1 supplies a rectified voltage to a precipitator 2 via decoupling components 3. The precipitator 2 includes a plurality of corona electrodes and collector electrodes, shown diagrammatically in FIG. 1 as a single corona electrode 4 and a single collector electrode 5. The decoupling components consist in principle of 3 elements, a decoupling-capacitor, -inductor and -resistor as shown in FIG. 6.

The decoupling capacitor has a threefold function: (a) It will protect the transformer-rectifier (TR) set from the high voltage pulses from the PFN. (b) It will absorb the energy of the driver not utilized as corona energy in the precipitator and will thus limit the duration of the high voltage on the precipitator. (c) During the recharge of the PFN, energy stored in the decoupler can be used to charge the PFN, thus avoiding a large voltage dip on the precipitator, which would otherwise occur during the recharge cycle as a result of the high impedance in the TR set.

The decoupling inductor acts as a high impedance for the high voltage pulses and prohibits the shorting out of the precipitator pulse voltage by the decoupling capacitors. The value of the inductor is chosen to be large enough to provide ample isolation between precipitator and decoupling capacitor for the duration of the pulse width and small enough to allow swift transfer of the energy not converted into corona energy from the precipitator to the decoupling capacitor. The inductance must also be small enough to provide a low voltage drop across it during the recharging of the PFN.

The decoupling resistor acts as damping element and will absorb the energy stored in the decoupling capacitor in case of precipitator sparking. Its value should be low to limit the $i^2R$ losses during normal operation and to keep the voltage drop small during the recharging of the PFN. On the other hand it must be large enough to ensure adequate damping during energy transfer from the precipitator to the decoupling capacitor and during sparking of the precipitator.

A typical set of values for a precipitator of 20 nF capacity would be:

$C_{decoupling}$ 200 nF
$L_{decoupling}$ 500 μH
$R_{decoupling}$ 50 ohms

A charging supply 6 charges one side of a pulse-forming network (PFN) 7, the other side of the PFN 7 being connected to the precipitator 2 and the d.c. base supply 1 via the decoupling components 3. As shown in FIG. 1, the PFN 7 is usually connected to the corona electrode 4, since it is from the corona electrode 4 that the electrons are emitted which form the particulate-charging ions.

The junction between the charging supply 6 and the PFN 7 is connected to one side of a transfer switch 8, the other side of which is connected to ground. The side of the charging supply 6 which is not connected to the PFN 7 is connected to ground, and the side of the d.c. base supply 1 which is not connected to the decoupling components 3 is also connected to ground. The PFN 7 can thus be charged by the charging supply 6 through the d.c. base supply 1 during those periods when the transfer switch 8 is open.

The d.c. base supply may be a transformer-rectifier set, or any other source of d.c. voltage, and usually provides about −40 kilovolts to the corona electrode 4. The charging supply 6 may be a transformer-rectifier set, or a pulse transformer, or an inverter supply, or any other suitable supply.

In carrying out this invention with the apparatus above described, the substantially constant high voltage is supplied by the d.c. base supply 1. The charging and transport function is controlled by the voltage of the d.c. base supply 1.

The pulse voltage is supplied by the pulse generator. The sequence of events leading to each pulse is as follows. The PFN 7 is charged by the charging supply 6 through decoupling components 3 and the d.c. base supply 1 until the voltage across the transfer switch 8 is at the required level. The transfer switch 8 is then closed, whereupon the energy stored in said PFN 7 is applied to the precipitator 2 in the form of a high voltage pulse of steep wavefront. The charging supply 6 is turned off, or has its current output limited, so that the transfer switch 8 may be reopened to permit recharging of the PFN 7 for the next pulse. The corona production is primarily determined by the peak voltage and repetition rate. The peak voltage is comprised of the pulse voltage superimposed on the base voltage; the pulse voltage being determined by the voltage of the charging supply 6 and the base voltage being determined by the d.c. base supply 1. It will also be observed that substantially all energy removed from the PFN 7 during the pulse is transformed into corona with any unused energy being distributed among the PFN, the precipitator and decoupling capacitor.

Figure 2:
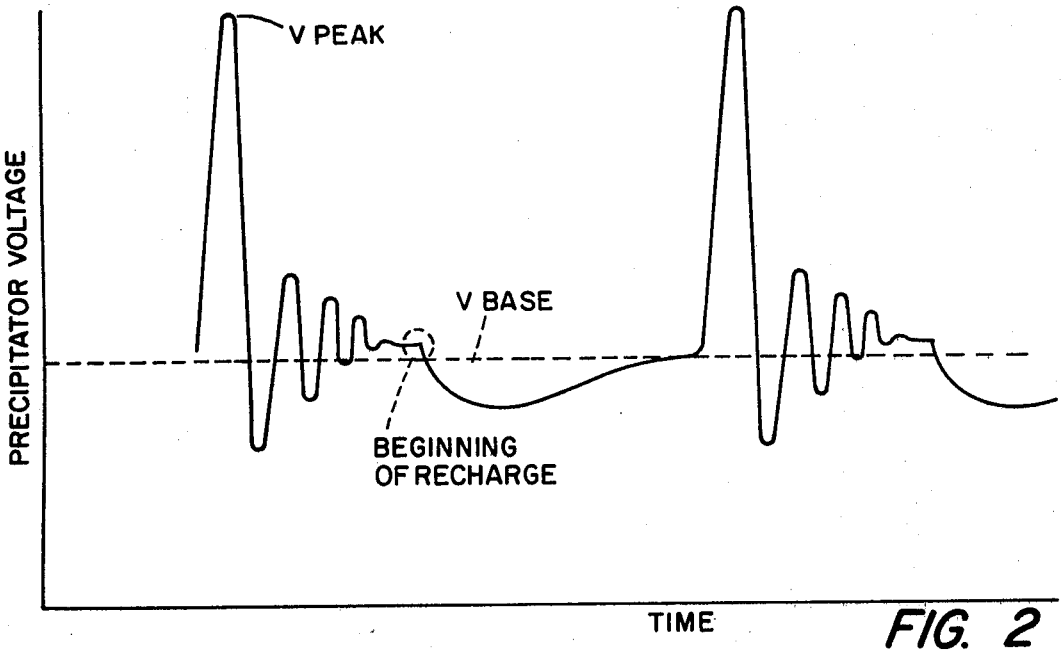
FIG. 2 is a graph of the operation of the circuit of FIG. 1, in which the voltage of the precipitator is plotted against time.

Referring now to the graph of FIG. 2, therein is shown a voltage applied to the precipitator electrodes 4, 5 by the circuit of FIG. 1. The temporal duration of the pulse has been exaggerated for clarity. As stated above, it is highly desirable to be able to vary the peak voltage, $V_{peak}$, and the mean voltage between pulses, $V_{base}$. Referring to FIG. 1, if the terminal of the PFN 7 connected to the transfer switch 8 is at a voltage $V_c$ just before the transfer switch 8 operates, and if the mean d.c. base supply voltage is $V_t$, then:

$$V_{base}=V_t$$

$$V_{peak}=V_t+V_cD$$

where small losses in the decoupling components 3, transfer switch 8 and connecting wires have been ignored and where D is the pulse division ratio between the PFN 7 and the precipitator 2.

The crucial feature of this invention lies in the attachment of the transfer switch 8 and the charging supply to the same, or input, port of the PFN 7 while the other, or output, port of the PFN 7 is directly connected to the precipitator 2 and the d.c. base supply 1 via the decoupling components 3.

This arrangement is both efficient and allows separate variation of the voltages $V_{base}$ and $V_{peak}$.

CONTRAST WITH PREVIOUS PRACTICE

Figure 3:
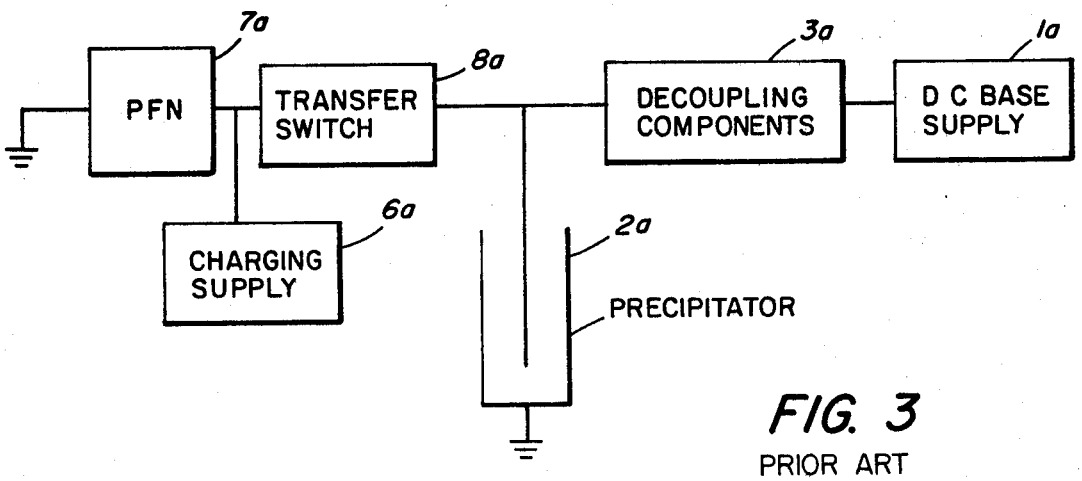
FIG. 3 PRIOR ART
FIG. 3 is a block diagram similar to that of FIG. 1, but showing one circuit of the prior art.

The circuit of FIG. 3 has been proposed by Lissman for use with electrostatic precipitators (see FIG. 2 of his U.S. Pat. No. 1,959,374). This circuit suffers from two disadvantages. Firstly, the voltage of the charging supply 6a is very high as it must be greater than the sum of the pulse and base voltages. In a typical installation this may be over 100 kV, leading to onerous insulation requirements and a large and heavy construction. The second disadvantage lies in the restriction of flexibility. The voltage Vbase has a minimum value which depends on the pulse generator, and the precipitator characteristics, such as a gas and particulates being treated at any particular time. For high resistivity dust, the pulse voltage may not decay sufficiently between pulses, resulting in an excessively high base voltage $V_{base}$. This situation means that if the optimal value of $V_{base}$ is less than that allowed by dissipation, the d.c. base supply 1a supplies no energy to the precipitator 2a and reducing the voltage of the d.c. base supply 1a to zero has no effect on the value of $V_{base}$. If, on the other hand, the optimal value of $V_{base}$ is greater than that set by pulse dissipation in the absence of the d.c. base supply 1a, then the d.c. base supply 1a can be used to set $V_{base}$ to the optimal value.

The crucial difference between the circuits of FIG. 1 and FIG. 3 lies in the fact that the PFN 7a is charged by the charging supply 6a through ground in the circuit shown in FIG. 3, but is charged through the d.c. base supply 1 in the circuit shown in FIG. 1.

Figure 4:
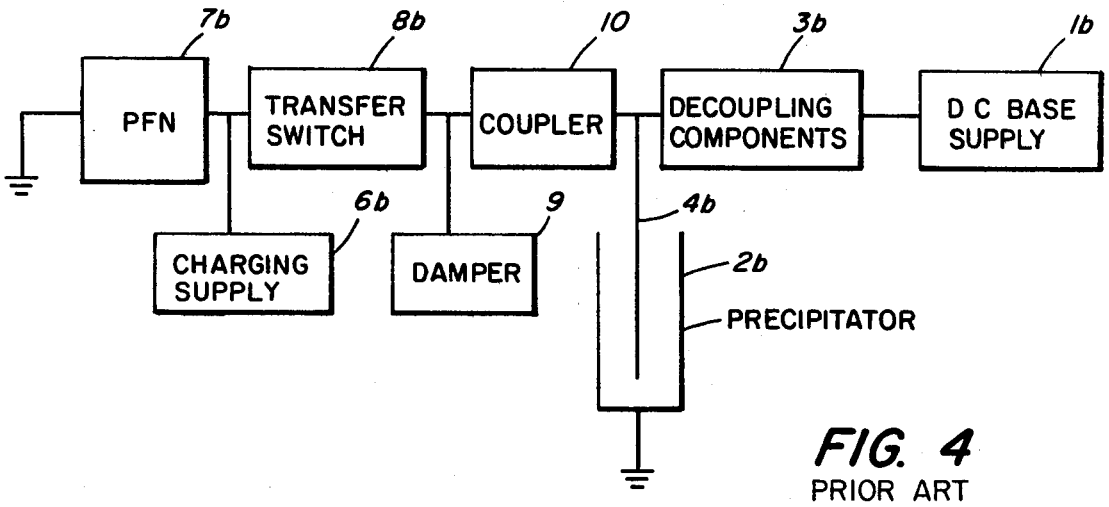
FIG. 4 PRIOR ART
FIG. 4 is a block diagram similar to that of FIG. 1, but showing another circuit of the prior art.

Referring now to FIG. 4, therein is shown a conventional circuit in use at the present time, c.f. Milde, H. I. and Feldman, P. L. "Pulse energization of electrostatic precipitators". 1978 Conference Record of IEEE-IAS-1978 Annual Meeting. The d.c. base supply 1b supplies a substantially constant voltage to the precipitator 2b via decoupling components 3b. The charging supply 6b charges a PFN 7b. A transfer switch 8b is connected between the high voltage terminal of the PFN 7b and a dampler 9. A coupler 10 connects the transfer switch 8b to the precipitator 2b. The pulse generator is formed by the PFN 7b, charging supply 6b and transfer switch 8b. The coupler 10 usually takes the form of a capacitor which allows pulse voltage from the pulse generator to reach the precipitator 2b, while preventing a steady current from the d.c. base supply 1b from flowing through the transfer switch 8b or damper 9. The crucial difference in the circuit of FIG. 4 and the circuit of FIG. 1 is that the PFN 7*b* is charged from the charging supply 6*b* to ground in FIG. 4, but through the d.c. base supply 1 in FIG. 1.

The voltage required from the d.c. base supply 1*b* is very similar to that of FIG. 1 as $$V_{base}=V_t$$

Somewhat more voltage is required from the charging supply 6*b* as $$V_{peak}=V_t+V_cFD$$

where F is less than unity and accounts for pulse loss in the coupler 10 and where D is the pulse division ratio between the PFN 7*b* and the precipitator 2*b*. A typical value for F is 0.9.

A more serious disadvantage of this circuit of FIG. 4 lies in the losses in the damper 9. Part of the pulse energy flows into this component, the proportion depending on the relative impedances of the precipitator 2*b* and the damper 9. A high impedance for the damper 9 reduces this wasted energy, but practical considerations prevent the impedance from being raised enough to reduce the losses to a negligible amount. After the pulse has been dissipated it is necessary to recharge the PFN 7*b* and the coupler 10. The coupler 10 is only partially discharged, but it must be recharged through the damper 9 and a high value for the resistance of the damper 9 leads to higher losses.

The proposed circuit thus eliminates at least two of the components of the circuit of FIG. 4, viz: the coupler 10 and the damper 9. These components are major parts of one presently used system and contribute significantly to its cost. The circuit of the invention also eliminates the losses associated with these components.

Figure 5:
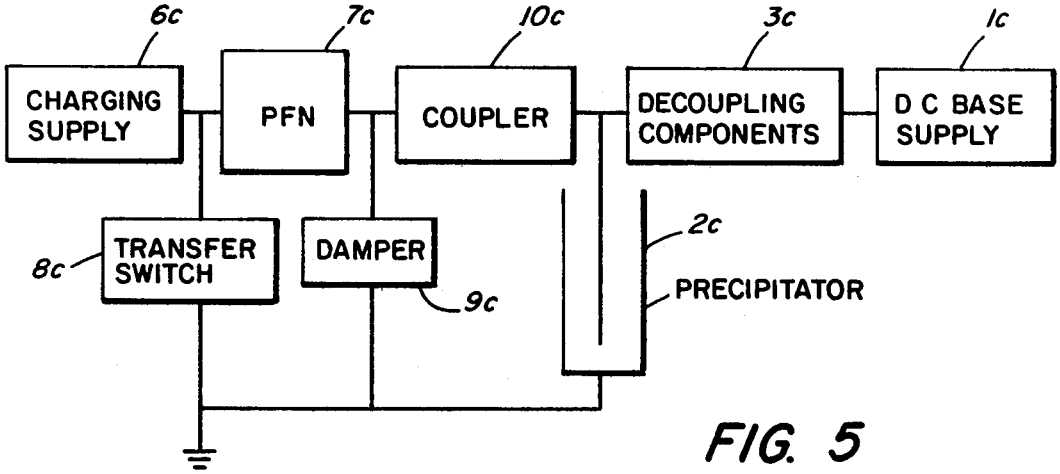
FIG. 5 PRIOR ART
FIG. 5 is a block diagram similar to that of FIG. 1, but showing still another circuit of the prior art.

Referring now to FIG. 5, therein is shown still another circuit of the prior art: namely one described by Milde in his U.S. Pat. No. 4,133,649. It is similar to that of FIG. 4, but the positions of the PFN (7*b* in FIG. 4 and 7*c* in FIG. 5) and the transfer switch (8*b* in FIG. 4 and 8*c* in FIG. 5) have been changed. The circuit of FIG. 5 differs from that of FIG. 1 in that two components have been added viz the coupler 10*c* and the damper 9*c*. As with the circuit of FIG. 4, the circuit of FIG. 5 differs from that of FIG. 1 in that the PFN 7*c* is charged through the damper 9*c* to ground in FIG. 5 rather than through the d.c. base supply 1 as in FIG. 1.

Other distinctions between the circuit of the present invention and those of the prior art include the following:

In the prior art device of FIG. 3, the charging supply must furnish 90 kilovolts, and the circuit does not disclose any particular means for controlling matters during discharge (which produces the pulse on the corona electrode of the precipitator) or during charge of the pulse forming network.

In the prior art device of FIG. 4, the provision of the coupler 10 permits the charging supply to operate at −50 kilovolts rather than the full −90 kilovolts, since the firing of the transfer switch 8*b* will suddenly lift the potential on both sides of the coupler by −50 kilovolts; this lifts the −40 kilovolt d.c. already on the corona electrode 4*b* to the desired −90 kilovolts. The damper 9 provides control of the discharge mode, because its properties are known, and reduces reliance on the discharge properties of the precipitator itself.

The prior art device of FIG. 5 is similar in operation to that of FIG. 4, except that the location of the transfer switch has been changed and the charging supply now furnishes +50 kilovolts to the "rear end" of the pulse forming network, whereas in the circuit of FIG. 4 the pulse charging supply furnished −50 kilovolts to the "front end" of the pulse forming network. The operation of the coupler 10 and damper 9 is the same in both FIGS. 4 and 5.

The circuit of the invention (FIG. 1) differs from that of FIG. 5 in that the coupler and the damper have been eliminated, a portion of their function being assumed by the precipitator itself, and a portion of their function being assumed by proper adjustment of the circuitry of the d.c. base supply 1 and the decoupling components 3. In the circuit of the invention the pulse forming network receives +50 kilovolts at its "rear end" from the charging supply 6, and receives −40 kilovolts at its "front end" from the d.c. base supply 1, so that the total voltage difference of 90 kilovolts is applied to the pulse forming network 7. It has been found that during the discharge mode the parameters of the precipitator and decoupling components can be so adjusted as to provide sufficient control. After application of the pulse, it is desired that the voltage of the corona electrode drop by a substantial amount rather quickly, but it must not fall too much, or else the transportation of particles in the precipitator will not proceed properly. The d.c. base supply 1 is selected so as to have a high impedance, this usually being accomplished by the presence of a substantial inductance in the primary circuit of the transformer-rectifier set which constitutes the d.c. base supply 1. When the transfer switch 8 opens to start the charge mode, the "rear end" of the pulse forming network 7 is at zero volts and gets recharged to +50 kilovolts, and the potential of the "front end" of the pulse forming network 7 will depend on the extent to which the pulse forming network was discharged during the discharge mode: it will be approximately −40 kilovolts for complete energy transfer from stored energy to corona energy. For negligible energy transfer the voltage will be approximately 10% higher depending on the ratio of PFN capacity to decoupling capacity. The effect of the opening of the transfer switch 8 and the subsequent recharging of the PFN 7 by the charging supply 6 is to reduce the negative voltage on the corona electrode 4, as indicated in FIG. 2. This is counteracted by the action of the dc base supply 1 and the decoupling components 3. With the high impedance of the d.c. base supply 1, it in itself will supply restorative negative charge at a slow rate, but the decoupling capacitor can furnish the necessary negative charge at a sufficiently fast rate to prohibit a serious voltage drop on the precipitator.

As indicated, the d.c. base supply 1 may be a transformer-rectifier set with high impedance. The decoupling components 3 may comprise a capacitative connection to ground and a suitable resistance and inductance between it and the precipitator. Alternatively, the decoupling components 3 may comprise a combination of inductances and capacitances.

VARIATIONS OF THE PRESENT INVENTION

The circuit shown in FIG. 1 and described hereinabove is the preferred embodiment of the invention. It will be understood that the benefit and advantages of the present invention are not limited to a particular circuit, or assembly of components. Devices such as thyratrons, silicon controlled rectifiers, spark gaps or vacuum switches may be substituted for the transfer switch 8. The d.c. base supply 1 may be any source of rectified voltage. The charging supply 6 is shown directly connected to the PFN 7. The charging supply 6 may take many forms, some of which require a decoupling impedance and/or cabling between the charging supply 6 and the PFN 7. Lastly, the PFN 7 could be replaced by a capacitor or any plurality of capacitors, resistors and inductors whose function is to influence the pulse shape.

What is claimed is:

1. An electrostatic precipitator circuit comprising:

(a) precipitator electrodes including at least one corona electrode and at least one collector electrode;

(b) a voltage source of rectified voltage connected across said precipitator electrodes so as to charge them to that voltage and deliver continuous current;

(c) a pulse forming network (PFN) adapted to deliver pulsed currents to the corona electrode of the precipitator;

(d) means for charging said PFN including, in combination with said voltage source which applies voltage of one polarity to one side of said PFN, a charging supply which applies voltage of opposite polarity to the other side of said PFN;

(e) a transfer switch connecting said collector electrode to said corona electrode through said PFN, so that closing said switch discharges the PFN across said precipitator electrodes.

2. A circuit according to claim 1, wherein said transfer switch comprises a thyratron.

3. A circuit according to claim 1, wherein said transfer switch comprises a silicon controlled rectifier.

4. A circuit according to claim 1, wherein said transfer switch comprises a spark gap.

5. A circuit according to claim 1, wherein said means for charging said PFN includes a rectified voltage source.

6. A circuit according to claim 1, wherein said means for charging said PFN is not of constant voltage but supplies energy in a nonconstant manner, either continuous or discontinuous.

7. A circuit according to claim 1, wherein said PFN is a capacitor.

8. A circuit according to claim 1, wherein the means whereby the precipitator electrodes are connected to the voltage source include decoupling components.

9. A circuit according to claim 8 wherein said decoupling components include a decoupling capacitor connected in parallel with said voltage source by having a first plate thereof connected to a first junction point between said voltage source and said corona electrode and by having a second plate thereof connected to a second junction point between said voltage source and said collector electrode and adapted (a) to protect said voltage source from the high voltage pulses from said PFN, (b) to limit the duration of the high voltage on the precipitator by absorbing the energy of the PFN not utilized as corona energy in the precipitator, and (c) to charge the PFN during the recharge thereof.

10. A circuit according to claim 9 wherein said decoupling components include a decoupling inductor connected in series between said first junction point and said corona electrode, said decoupling inductor being large enough to provide ample isolation between said precipitator electrodes and said decoupling capacitor for the duration of the pulse width, said decoupling inductor being small enough (a) to allow swift transfer of the energy not converted into corona energy from said precipitator electrodes to said decoupling capacitor and (b) to provide a low voltage drop across it during the recharging of said PFN.

11. A circuit according to claim 9, wherein said decoupling components include a decoupling resistor connected in series with said decoupling inductor between said first junction point and said corona electrode and low enough (a) to limit the $I^2R$ losses during normal operation and (b) to keep the voltage drop small during the recharging of the PFN, said decoupling resistor being large enough to ensure adequate damping during energy transfer from said precipitator electrodes to said decoupling capacitor and during sparking of the precipitator.

* * * * *